US006688656B1

(12) United States Patent
Becken

(10) Patent No.: US 6,688,656 B1
(45) Date of Patent: Feb. 10, 2004

(54) MULTI-POINT LOCK

(75) Inventor: Donald A. Becken, Burbank, CA (US)

(73) Assignee: Truth Hardware Corporation, Owatonna, MN (US)

( * ) Notice: Subject to any disclaimer, the term of this patent is extended or adjusted under 35 U.S.C. 154(b) by 16 days.

(21) Appl. No.: 09/717,670

(22) Filed: Nov. 21, 2000

Related U.S. Application Data

(60) Provisional application No. 60/167,019, filed on Nov. 22, 1999.

(51) Int. Cl.[7] ..... E05C 19/10

(52) U.S. Cl. ..... 292/26; 292/30; 292/35; 292/41

(58) Field of Search ..... 292/8, 11, 24–26, 292/29, 30, 35, 36, 41, 44, 47, 48, 53, 45

(56) References Cited

U.S. PATENT DOCUMENTS 1,023,766 A * 4/1912 Sinclair ..... 292/5
1,402,964 A * 1/1922 Robertson ..... 292/29
2,166,535 A * 7/1939 Sarenholm ..... 292/5
3,342,516 A * 9/1967 Morand ..... 292/6
3,586,360 A * 6/1971 Perrotta ..... 292/97
4,639,021 A * 1/1987 Hope ..... 292/7
5,791,700 A * 8/1998 Biro ..... 292/7
5,820,170 A * 10/1998 Clancy ..... 292/26
5,951,068 A 9/1999 Strong et al. ..... 292/39

* cited by examiner

*Primary Examiner*—Gary Estremsky
(74) *Attorney, Agent, or Firm*—Lorusso Loud & Kelly LLP

(57) ABSTRACT

A multi-point lock and method for locking with two remote mortise locks operated by a central actuator to which they are mechanically linked. The mortise locks are mounted with opposite orientation so that they simultaneously engage separate keepers from opposite directions. A housing of the multi-point lock is adapted to allow the placement of mounting screws along the entire length of the lock.

4 Claims, 9 Drawing Sheets

MULTI-POINT LOCK

CROSS-REFERENCES TO RELATED APPLICATIONS

This application claims benefit to provisional application 60/167,019 filed Nov. 22, 1999.

BACKGROUND OF THE INVENTION

This invention relates to locks for patio doors, and more particularly to a lock adapted to allow the placement of mounting screws at multiple points along the entire length of the lock.

Existing lock assemblies for sliding glass doors are limited in both the number and locations available for the placement of mounting screws. The typical lock assembly for a sliding glass door with its enclosed design can only accommodate placement of mounting screws at the extreme ends of the lock due to the fact that the entire lock assembly is enclosed within a housing assembly.

Multi-point latch mechanisms for sliding glass doors have been described in related art such as U.S. Pat. No. 5,820,170. This existing lock mechanism teaches the use of an upper and a lower actuator connected by a gang link. An upper link causes pivotal movement of the upper latch, and a lower link causes pivotal movement of a lower latch. Advantageously, in contrast to the prior art, the proposed design includes a central actuator coupled to two standard mortise locks-i.e. Commonly known to those skilled in the art of linkage assembly. The linkage assembly consists of two linkage rods connected to the top and bottom of this central actuator such that rotation of the hub of this central actuator causes the upper and lower mortise locks to become engaged or disengaged depending on the direction of rotation of the central actuator hub.

The use of a single central actuator hub for the deployment of the hooks in the mortise lock components also contributes to another advantage over the prior locks. Specifically, this hook deployment action is so precise that the translational movement of the opposed hooks within the keepers is so circumscribed that the size of the keepers may be reduced. Advantageously, the smaller keeper opening creates a stronger locking force for the multi-point lock.

The use of common, off the shelf mortise locks as components for the instant invention has additional advantages. Namely, the production and replacement costs of the lock of the present invention are reduced, thus making the instant design more competitive in the marketplace. In addition, the proposed locking system also uses fewer total components to achieve its multi-lock function. Advantageously, this also reduces the total cost of the lock assembly.

Accordingly, it is an object of the instant invention to provide an improved lock assembly whereby the number and location of sites for the placement of mounting screws is increased to incorporate the entire length of the lock.

Still another object of the instant invention is to provide a multi-point lock having a single central actuator hub which is responsible for the deployment of the opposed hooks in the mortise lock components in an efficient and reliable manner such that fewer total components are used in the design.

Still another object of the invention is to provide an improved multi-point lock with a precise hook deployment such that the size of the keeper holes with which said hooks become engaged can be reduced.

A further object of the instant invention is to provide an improved multipoint lock having reduced production and replacement costs attributed to a design which incorporates mortise lock components common to those skilled in the art.

These and other objects of the present invention will become apparent from a review of the description provided below.

SUMMARY OF THE INVENTION

The instant invention is organized about the concept of providing a multi-point lock, which may be used for sliding patio doors, in which the multi-points of engagement of the mortise lock hooks with their associated keepers is achieved by the use of a single central actuator hub which engages two remote actuators via a linkage rod assembly.

In an exemplary embodiment according to the instant invention, the multi-point lock comprises a central actuator hub, a linkage assembly pivotally engaged with the central actuator hub, two remote actuators, two mortise locks each of which has a hook which are in opposed orientation with each other. Rotation of the central actuator hub in turn causes movement of the linkage assembly that is pivotally attached to the central actuator hub. The linkage assembly is comprised of a straight actuator link and a dog leg actuator link. Movement of the straight actuator link in response to rotation of the central actuator hub in turn causes rotation of a first remote actuator. Likewise, movement of the dog leg actuator link in response to rotation of the central hub actuator causes rotation of a second remote actuator. Each of the remote actuators in turn actuates a mortise lock such that a hook in each of these mortise locks is deployed to engage a keeper mounted on the stile of the door.

DETAILED DESCRIPTION OF THE PREFERRED EMBODIMENT

Figure 1:
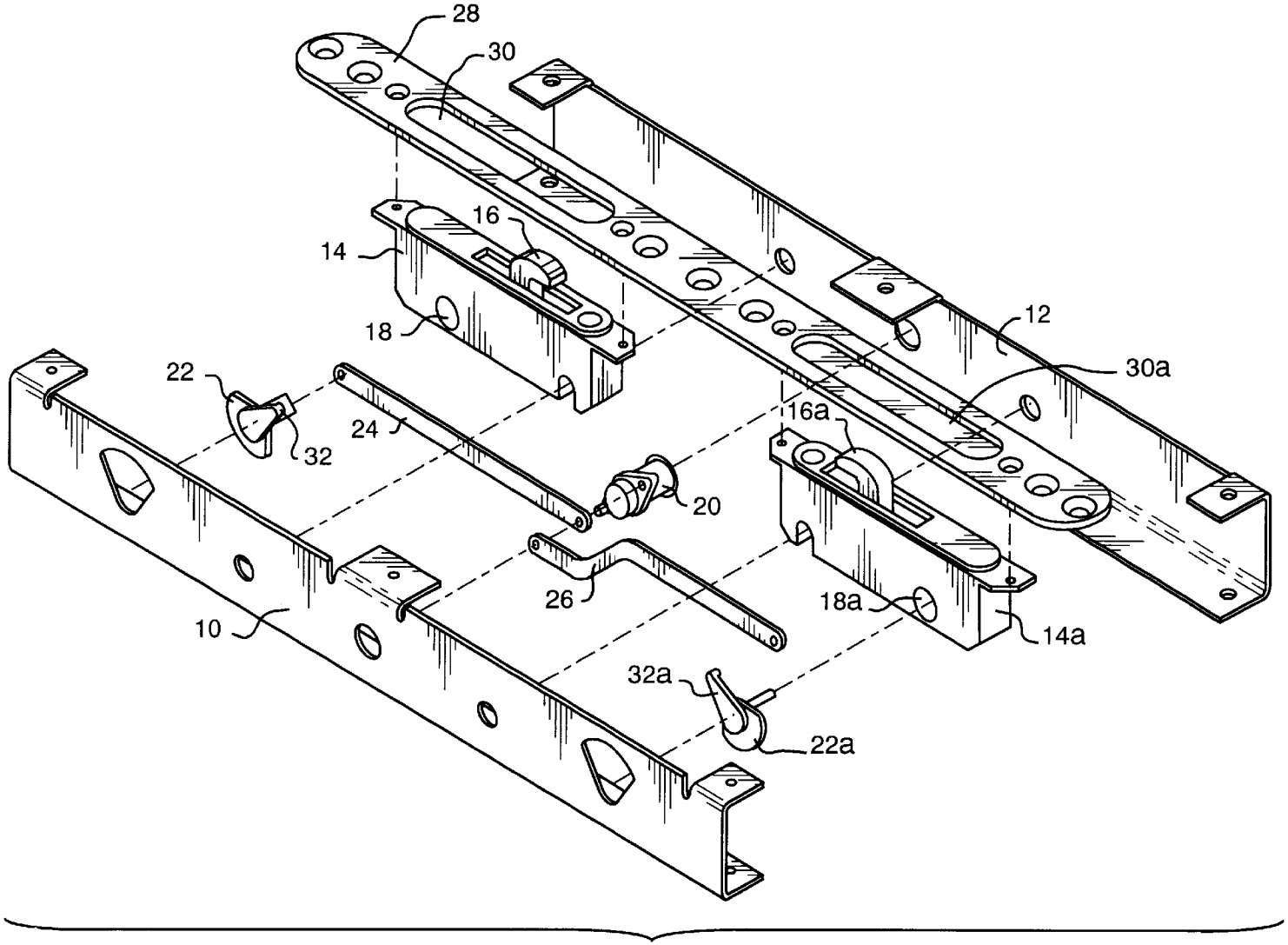
FIG. 1 is an exploded view of one important embodiment of the instant invention.

FIG. 1 illustrates an exemplary embodiment of the instant invention wherein the main components of the multi-point lock for patio sliding doors generally include a central actuator hub 20 adapted to compact with a linkage assembly comprising two linkage rods, a straight actuator link 24 and a dog leg actuator link 26, two mortise locks 14 and 14*a* each of which has a hook 16 and 16*a* which are in an opposed orientation in relation to each other, and a housing assembly having an inner housing 10, and outer housing 12. The straight actuator link 24 is pivotally attached to the top of the central actuator hub 20. The dog leg actuator 26 may be pivotally attached to the bottom of the central actuator hub.

Rotation of the central actuator hub 20 in turn causes the straight actuator link 24 to actuate a rotatable end cam 32 which is rigidly affixed to a first remote actuator 22. In turn, the first remote actuator 22 is adapted to compact with a first mortise lock hub 18. Rotation of the first mortise lock hub 18 in turn creates translation al motion such that a first opposed hook 16 of the mortise lock 14 may become engaged -i.e. In a locked position- or disengaged- i.e. In an unlocked position- with a keeper 30 attached to a face plate 28 disposed in a mortise (not shown) that is attached to a stile (not shown) in a manner familiar to those skilled in the art of mortise locks.

Referring again to FIG. 1, a 90 degree rotation of the central actuator hub 20 causes the dog leg actuator 26 to actuate a rotatable end cam 32a which is rigidly affixed to a second remote actuator 22*a*. In turn, the second remote actuator 22*a* is adapted to compact with a second mortise lock hub 18*a*. Rotation of the second mortise lock hub 18*a* creates a translation al motion such that a second opposed hook 16*a* of the mortise lock 14*a* may become engaged- i.e. In a locked position- or disengaged i.e. In an unlocked position- with a keeper 30*a* attached to a face plate 28 disposed in a mortise (not shown) that is attached to a stile (not shown) in a manner familiar to those skilled in the art of mortise locks.

Figure 2:
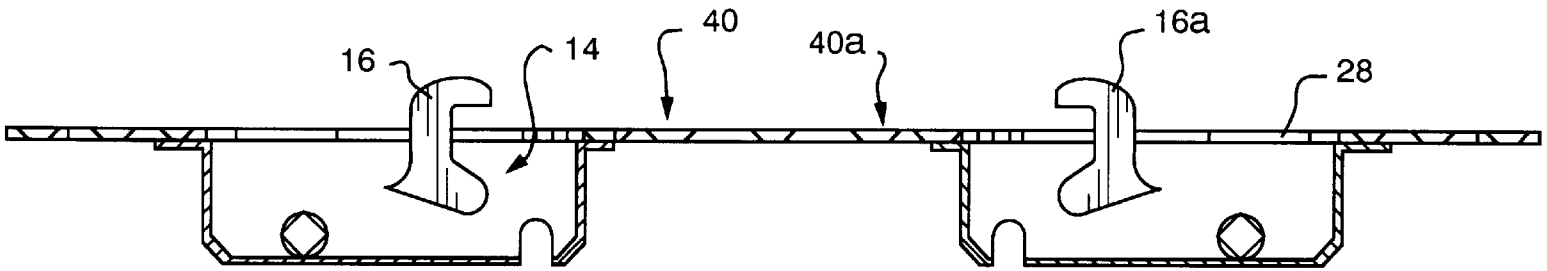
FIG. 2 is a side sectional view of the multi-point lock shown in FIG. 1.

Turning again to FIG. 1, advantageously the housing assembly consists of a two piece case cover the inner housing 10 and the outer housing 12 which are held together with appropriate fasteners in a manner familiar to those skilled in the art. Unlike closely related art such as U.S. Pat. No. 5,820,170 where the housing includes bottom, top, rear, front and side walls to create an completely enclosed lock, this two piece housing assembly allows for the use of additional mounting screws in the center of the lock. In contrast, existing lock assemblies allow for mounting screws only on the extreme ends of the lock due to their completely enclosed design. As shown in FIG. 2, the aforementioned advantage of multiple mounting screw locations 40, 40*a* located in the center of the lock is readily apparent.

Figure 3:
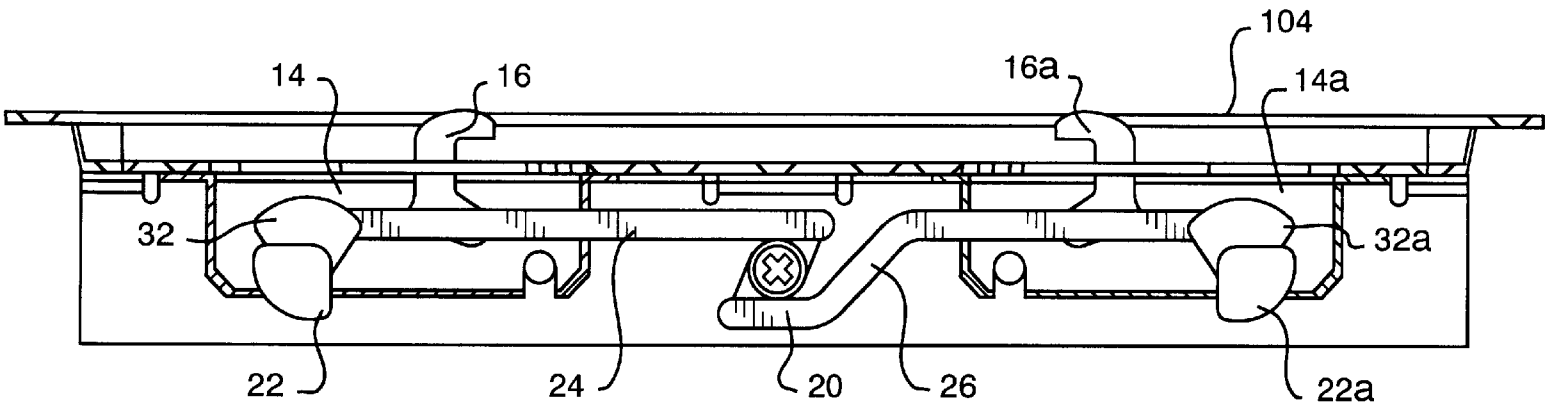
FIG. 3 is a side sectional view of an alternative embodiment of the multi-point lock of the instant invention wherein the multi-point lock may be recessed in an adapter prior to installation on a door stile.

Another advantageous feature of the instant invention associated with the central actuator hub 20 link assembly hook deployment action is that this hook deployment action allows for a smaller keeper opening which in turn creates a stronger locking force. As shown in FIG. 3, the two opposed hooks 16, 16*a* located in the two mortise locks 14, 14*a* are deployed by the rotation of the two remote actuators 22, 22*a* which in turn have been actuated by the straight actuator link 24 and the dog leg actuator link 26 respectively as a consequence of rotation of the central actuator hub 20. The instant invention's hook deployment action is characterized by the precise translation al motion of the opposed hooks 16, 16*a* triggered by the rotational movement of rotational remote actuators 22, 22*a*. Another advantageous feature of the instant invention is that fewer total components -i.e. Nine (9) including the two piece housing assembly reduces both the production costs as well as the costs associated with normal wear and tear of the lock assembly. These reductions in the total costs associated with the instant lock are directly attributed to the fact that there are fewer parts that will either wear out or break. Referring again to FIG. 1, the lock is comprised of (2) mortise locks 14, 14*a*, (2) remote actuators 22, 22*a*, (2) linkage rods, a straight actuator link 24, and a dog leg actuator link 26, and (1) central actuator hub 20 enclosed within a (2) piece housing assembly, inner housing 10 and outer housing 12.

Advantageously, reduction of production costs for this instant multi-point lock is also attributed to the use of "off the shelf components." As shown in FIGS. 1 and 2, the two mortise locks 14, 14*a* are well known to those skilled in the art. Use of these known locks shall make the instant invention more competitive in the marketplace.

Figure 4:
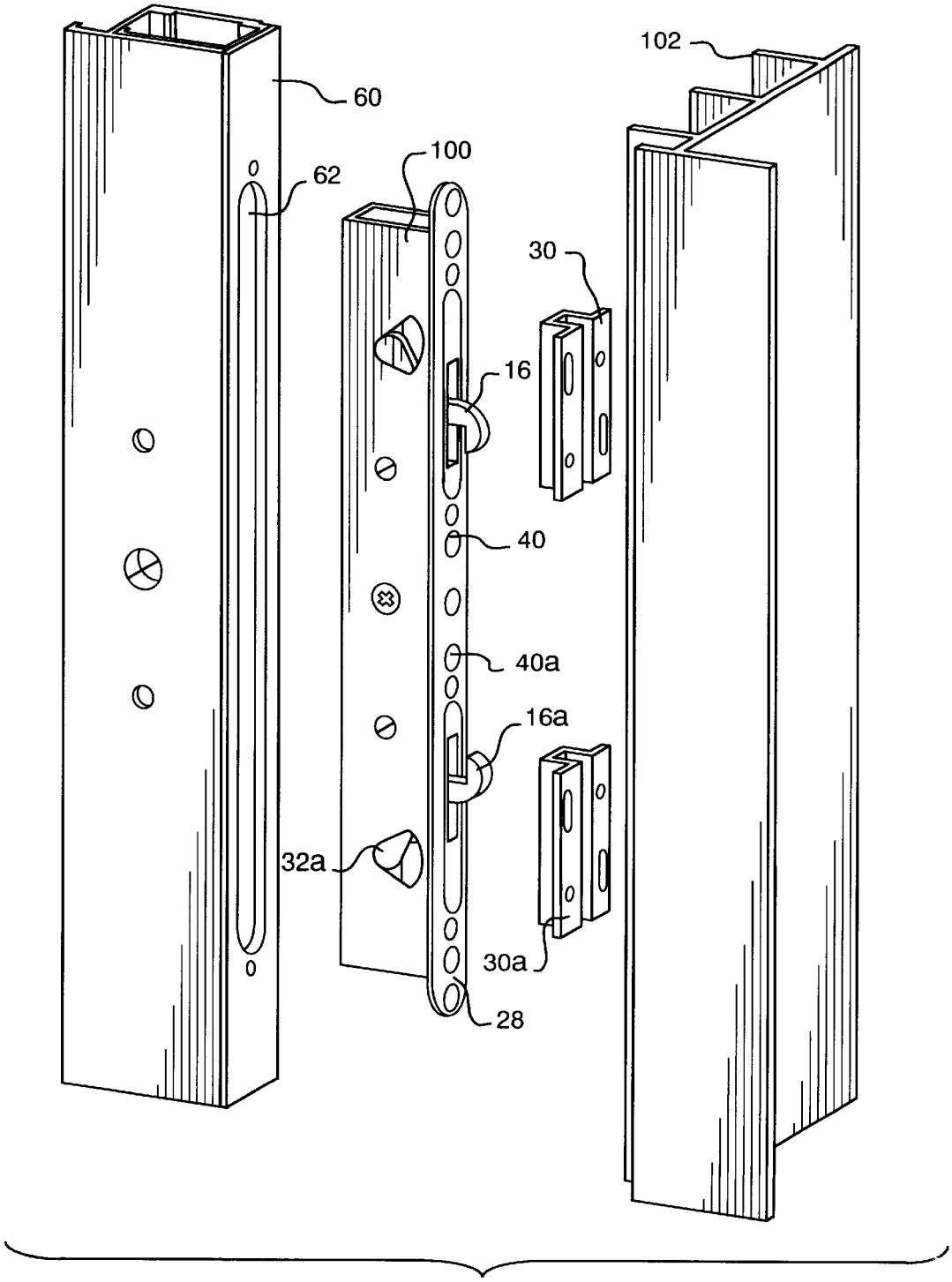
FIG. 4 is an exploded perspective of one embodiment of the instant invention wherein the multi point lock is mounted to a door stile via a face plate.
Figure 5:
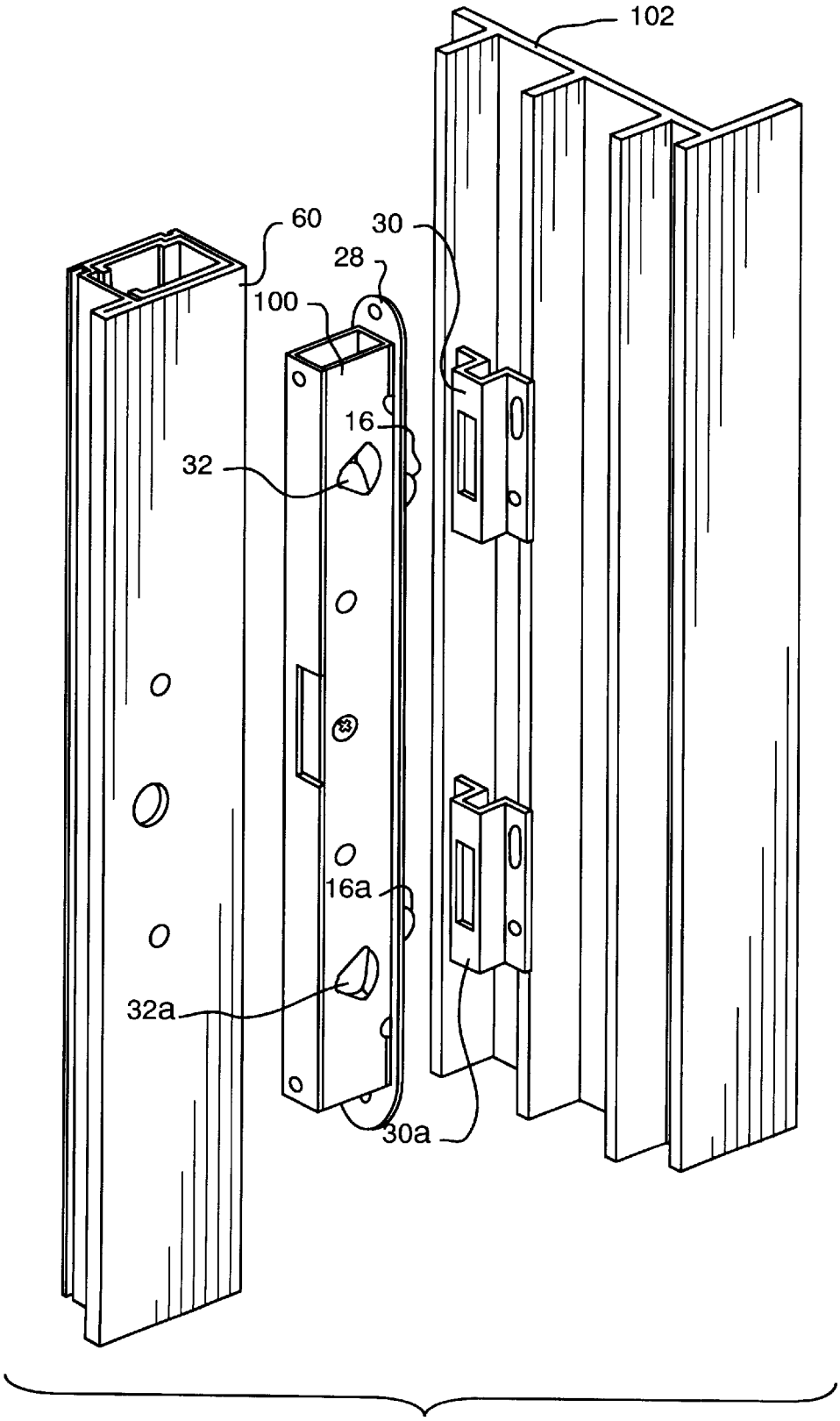
FIG. 5 is an exploded perspective of the multi point lock shown in FIG. 4 depicting co action with a keeper structure on an associated door jam.
Figure 6:
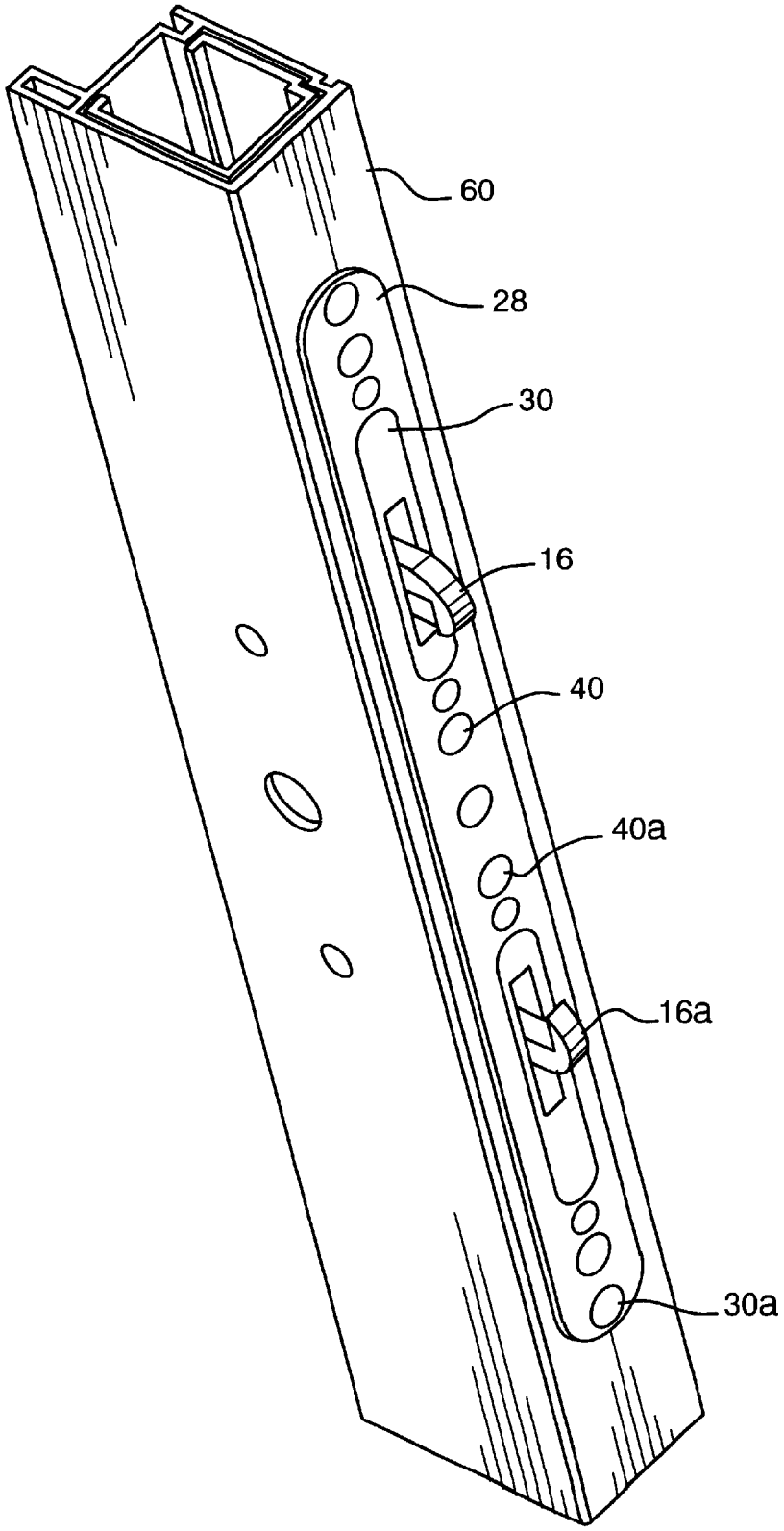
FIG. 6 is a magnified, partial top, partial side, view of the multi-point lock shown in FIG. 4.

Referring to FIGS. 4 and 5, the multi-point lock 100 is adapted to be fitted in a mortise 62 or opening in the lock face of the stile 60 of the sliding door (not shown) and is arranged for co action with keepers 30, 30*a* positioned on the associated door jam 102 and for co action with a handle assembly (not shown) mounted on the inside face of the stile 60 of the sliding door (not shown) in a manner well known to those skilled in the art.

With regard to the mounting of the multi-point lock, alternative embodiments of the multi-point lock are shown in FIGS. 4–10. Referring again to FIGS. 4 and 5, the multi point lock 100 may be mounted to the door stile 60 with a face plate 28. The face plate 28 is secured to the multi point lock 100 with fasteners in a manner well known to those skilled in the art. The face plate 28 mounting embodiment for the multi point lock is further detailed in FIG. 6. Advantageously, as shown in this magnified perspective, the face plate 28 has excised areas complementary in size and shape to the mortise locks 14, 14*a* so as to permit the opposed hooks 16, 16*a* to deploy freely from an engaged to a disengaged position.

Figure 7:
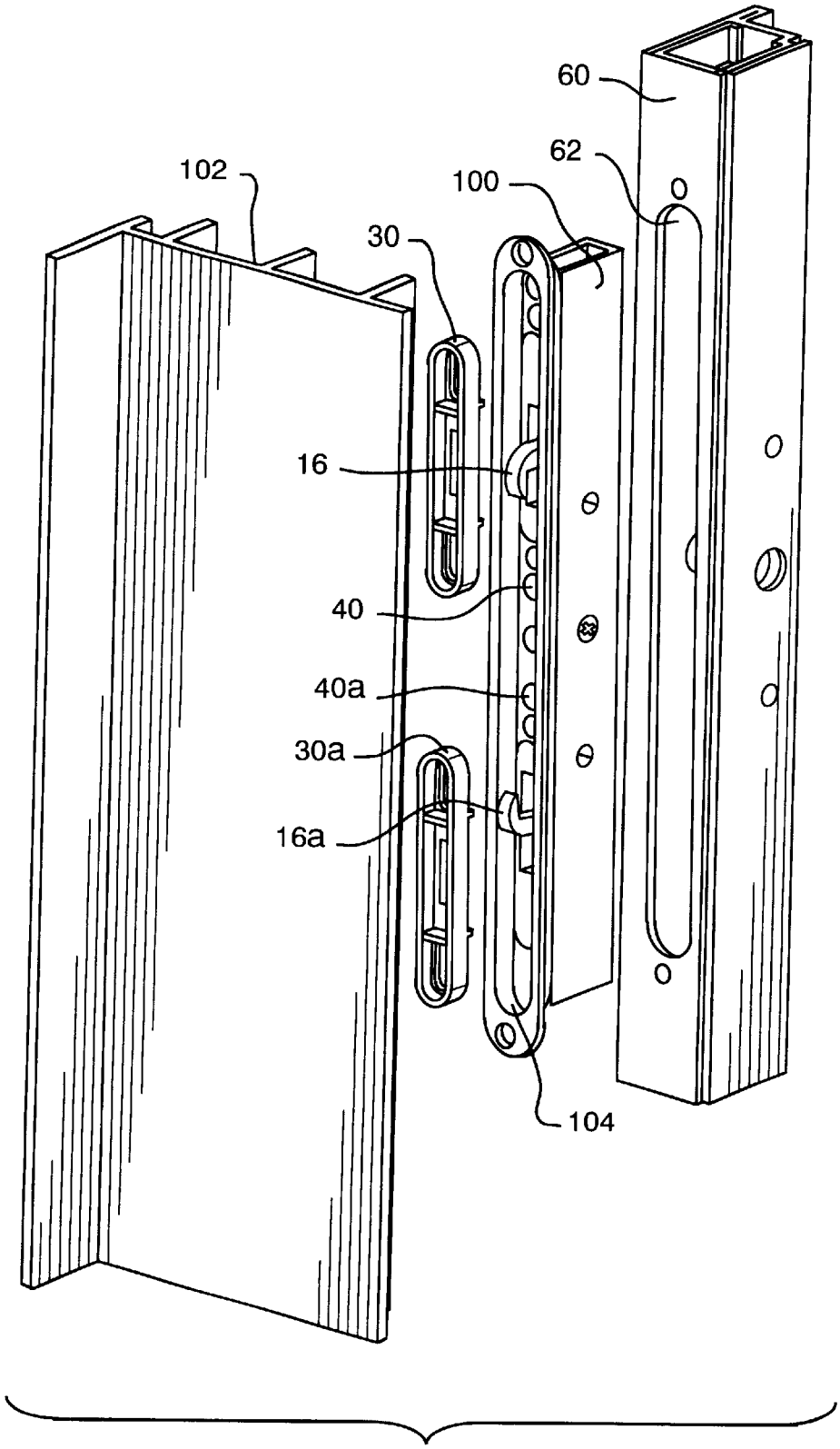
FIG. 7 is an exploded perspective of an alternative embodiment of the instant invention wherein the multi point lock is mounted to a door stile via a recessed adapter.
Figure 8:
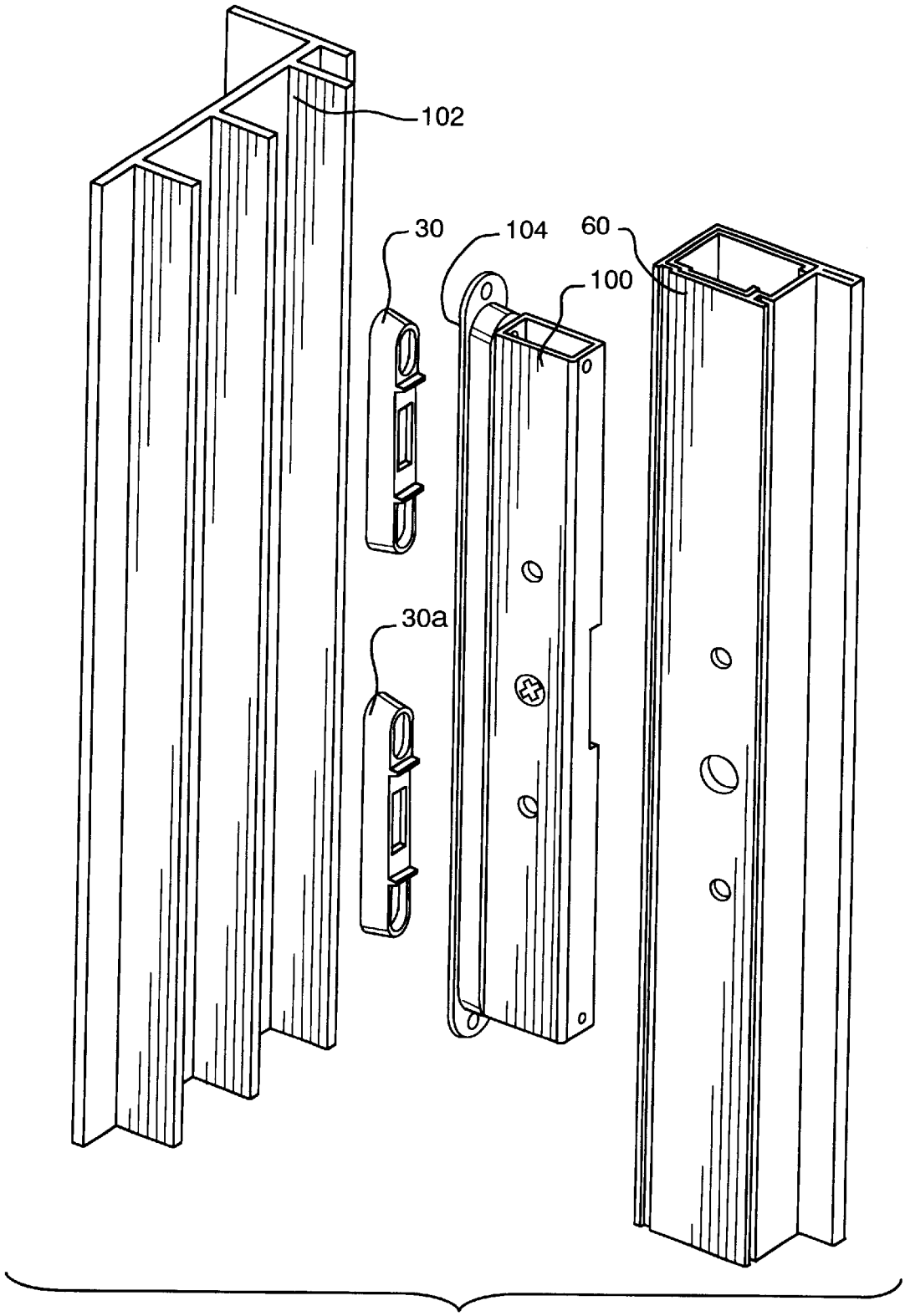
FIG. 8 is an exploded perspective of the multi point lock shown in FIG. 7 depicting co action with a keeper structure on an associated door jam.
Figure 9:
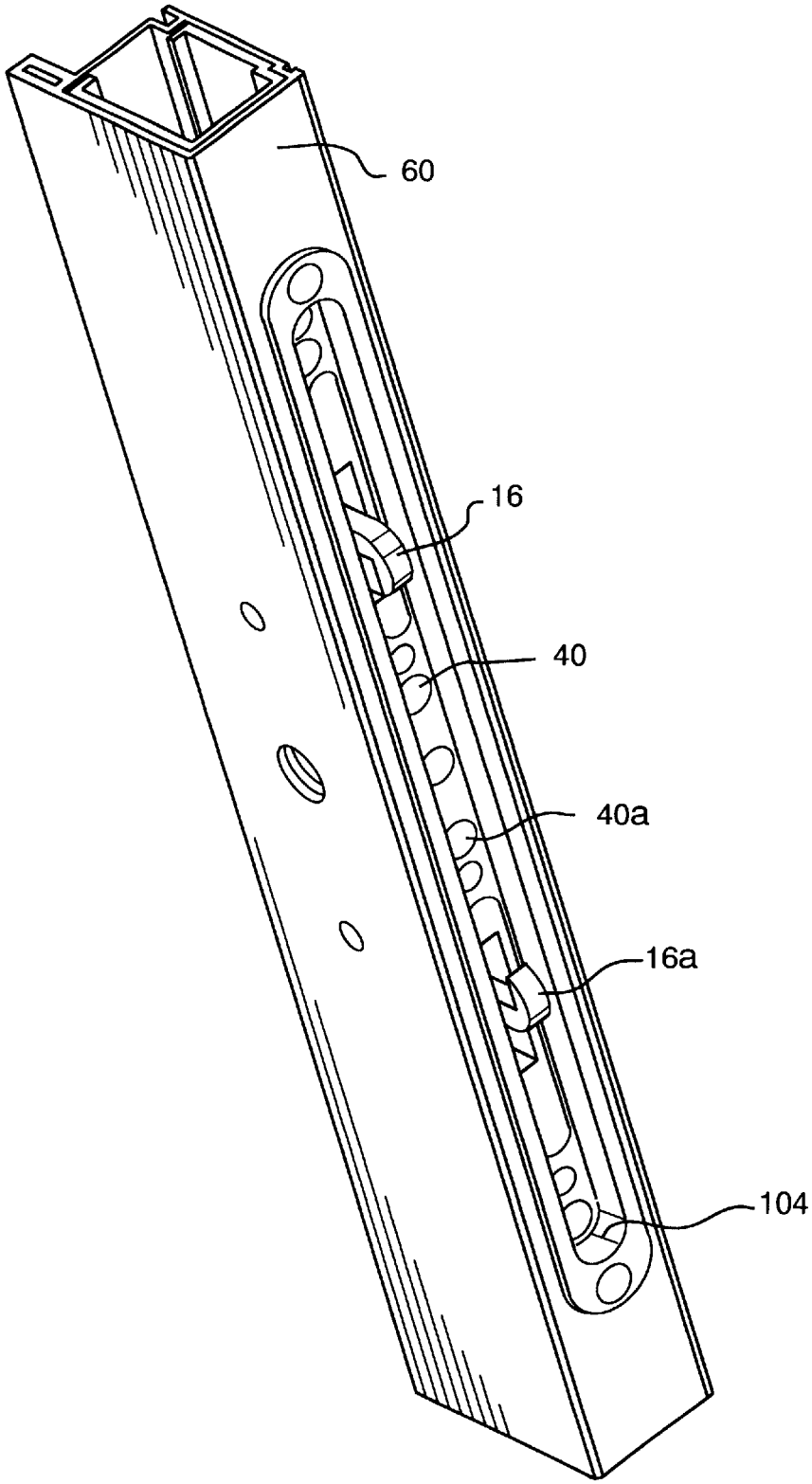
FIG. 9 is a magnified, partial top, partial side, view of the multi-point lock shown in FIG. 7.

In an alternative embodiment, as shown in FIGS. 7–8, the multi-point lock 100 may be mounted in a recessed adapter 104 that in turn is mounted into a door stile 60. The recessed adapter 104 is secured to the multi point lock with fasteners in a manner well known to those skilled in the art. This alternative embodiment with the recessed adapter 104 is further illustrated in FIG. 9. This magnified perspective of the alternative mounting embodiment depicts the advantageous configuration of the recessed adapter 104. The recessed adapter 104 has excised areas complementary in size and shape to the mortise locks 14, 14*a* so as to permit the opposed hooks 16, 16*a* to deploy freely from an engaged to a disengaged position.

Figure 10:
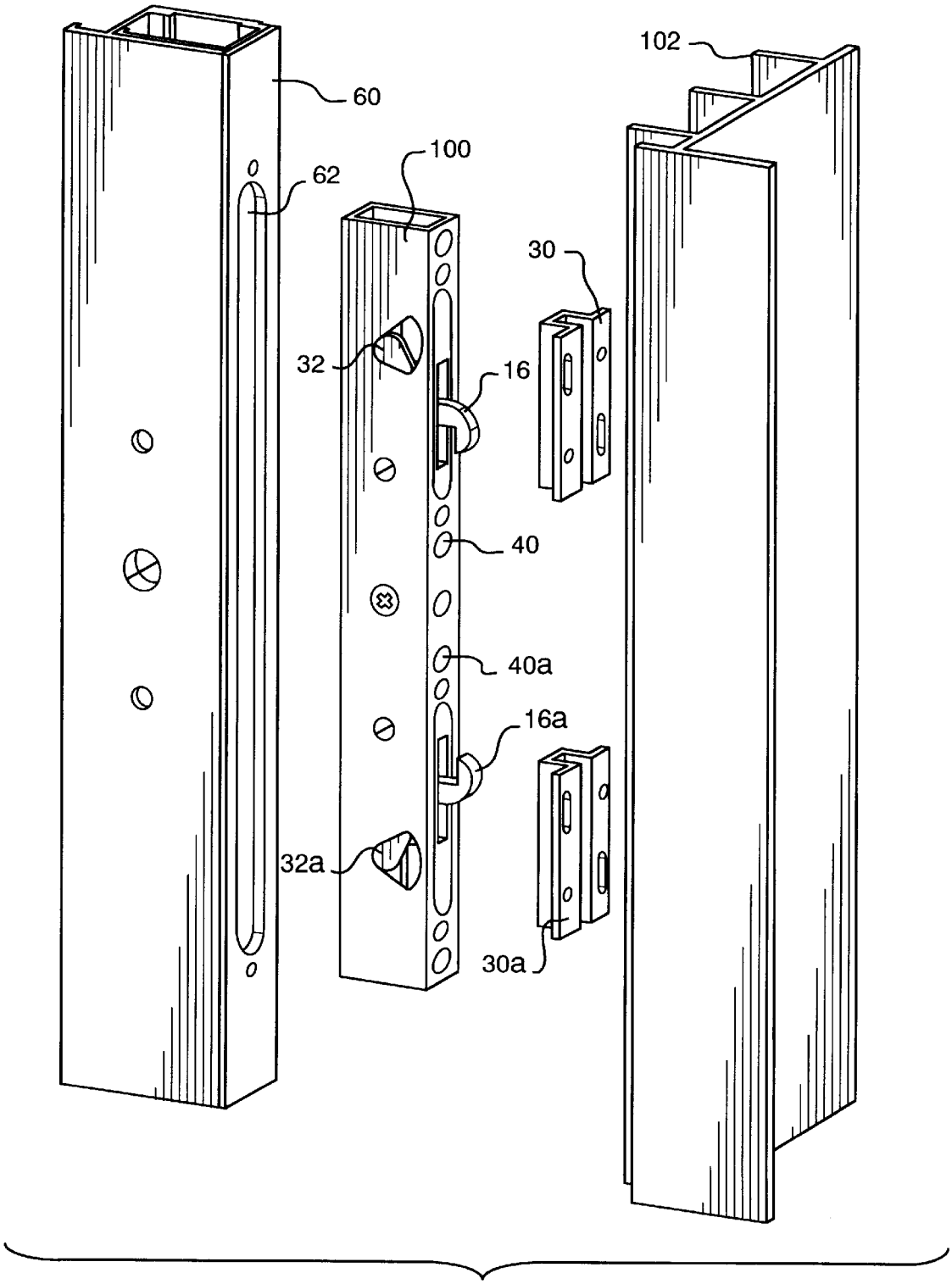
FIG. 10 is an exploded perspective of yet another embodiment of the instant invention wherein the multi point lock is mounted directly to a door stile.

As shown in FIG. 10, yet another embodiment of the instant invention envisions the multi point lock assembly 100 mounted directly to the face of the door stile 60.

Thus, according to the instant invention there is provided an improved multi-point lock that includes features for reducing the manufacturing costs, steps, and/or number of parts required in the production of such a multi-point lock while maintaining high quality and reliability. Additionally, the construction of the housing assembly of instant invention provides additional screw mounting sites in the center of the lock such that the user has greater flexibility with regard to the installation of the multi-point lock. The embodiments which have been described herein, however, are but some of the several which utilize this invention and are set forth here by way of illustration but not of limitation. It is obvious that many other embodiments, which may be readily apparent to those skilled in the art, may be made without departing materially from the spirit and scope of this invention.

I claim:

1. A multi-point lock which may be used for a sliding glass door comprising:

a central actuator hub;

a linkage assembly pivotally engaged with said central actuator hub, said linkage assembly having two linkage rods, wherein said two linkage rods comprise a straight actuator link and a dog leg actuator link;

a first and a second remote actuator, wherein said first remote actuator is pivotally engaged with said straight actuator link and said second remote actuator is pivotally engaged with said dog leg actuator link; and a first mortise lock having a first hook that engages a first keeper when said first mortise lock is actuated and a second mortise lock having a second hook opposed to said first hook that engages a second keeper when said second mortise lock is actuated, wherein upon rotation of said central actuator hub, said straight actuator link rotates said first remote actuator which in turn actuates said first mortise lock, and said dog leg actuator link rotates said second remote actuator which in turn actuates said second mortise lock.

2. The multi-point lock according to claim 1 further including a housing assembly wherein said housing assembly comprising an inner housing and an outer housing wherein said inner housing and said outer housing are held together by fasteners.

3. A multi-point lock according to claim 1 further comprising a housing assembly wherein said housing assembly comprises a plurality of mounting holes and wherein at least one of said plurality of mounting holes is disposed between said mortise locks.

4. A multi-point lock according to claim 2, wherein said housing assembly comprises a plurality of mounting holes and wherein at least one of said plurality of mounting holes is disposed between said mortise locks.

* * * * *